US007697855B2

(12) United States Patent
Fukami et al.

(10) Patent No.: US 7,697,855 B2
(45) Date of Patent: Apr. 13, 2010

(54) IMAGE FORMING APPARATUS

(75) Inventors: Tsunemitsu Fukami, Nagoya (JP); Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 11/848,434

(22) Filed: Aug. 31, 2007

(65) Prior Publication Data

US 2008/0056743 A1 Mar. 6, 2008

(30) Foreign Application Priority Data

Aug. 31, 2006 (JP) ..... 2006-235010

(51) Int. Cl.
*G03G 15/00* (2006.01)

(52) U.S. Cl. ..... 399/44; 399/71

(58) Field of Classification Search ..... 399/38, 399/44, 71, 302, 308, 343, 344, 357
See application file for complete search history.

(56) References Cited

U.S. PATENT DOCUMENTS 5,946,538 A * 8/1999 Takeuchi et al. ..... 399/302
6,678,493 B2 * 1/2004 Maeyama et al. ..... 399/302
2008/0008483 A1 * 1/2008 Hamaya et al. ..... 399/44

FOREIGN PATENT DOCUMENTS

JP 10-307489 * 11/1998
JP 2004-109386 4/2004

* cited by examiner

*Primary Examiner*—Hoan H Tran
(74) *Attorney, Agent, or Firm*—Banner & Witcoff, Ltd

(57) ABSTRACT

The present invention provides an image forming apparatus including a belt, a cleaning roller opposed to a surface of the belt, a voltage generating circuit generating a voltage applied to the cleaning roller, a voltage value detecting circuit detecting a voltage value applied to the cleaning roller, a control unit controlling the voltage generating circuit by inputting a control signal to the voltage generating circuit such that the voltage value detected by the voltage value detecting circuit is set to the same value as a target voltage value, and a target voltage value setting section setting the target voltage value based on a duty of the control signal input from the control unit to the voltage generating circuit.

5 Claims, 6 Drawing Sheets

FIG. 5

| T [℃] | ψ [%RH] | Ha [g/m3] |
|---|---|---|
| 32~ | 80~ | 30 |
| | 60~79 | 25 |
| | 40~59 | 18 |
| | 20~39 | 11 |
| | ~19 | 5 |
| 28~31 | 80~ | 27 |
| | 60~79 | 23 |
| | 40~59 | 16 |
| | 20~39 | 10 |
| | ~19 | 5 |
| 24~27 | 80~ | 22 |
| | 60~79 | 18 |
| | 40~59 | 13 |
| | 20~39 | 8 |
| | ~19 | 4 |
| 20~23 | 80~ | 20 |
| | 60~79 | 15 |
| | 40~59 | 10 |
| | 20~39 | 6 |
| | ~19 | 3 |
| 16~19 | 80~ | 14 |
| | 60~79 | 11 |
| | 40~59 | 8 |
| | 20~39 | 5 |
| | ~19 | 2 |
| 12~15 | 80~ | 10 |
| | 60~79 | 8 |
| | 40~59 | 6 |
| | 20~39 | 4 |
| | ~19 | 2 |
| ~11 | 80~ | 7 |
| | 60~79 | 6 |
| | 40~59 | 4 |
| | 20~39 | 2 |
| | ~19 | 1 |

FIG. 6

| Ha [g/m3] | AVERAGE PWM DUTY[%] | | | NV1 [V] | NV2 [V] |
|---|---|---|---|---|---|
| 10～30 | | ～ | 55.5 | -1000 | -1400 |
| | 55.6 | ～ | 60.5 | -1100 | -1500 |
| | 60.6 | ～ | | -1200 | -1600 |
| 5～9 | | ～ | 57.0 | -1100 | -1500 |
| | 57.1 | ～ | 62.5 | -1300 | -1700 |
| | 62.6 | ～ | 64.0 | -1500 | -1900 |
| | 64.1 | ～ | | -1700 | -2200 |
| 1～4 | | ～ | 65.0 | -1400 | -1800 |
| | 65.1 | ～ | 67.0 | -1600 | -2000 |
| | 67.1 | ～ | 67.5 | -1800 | -2300 |
| | 67.6 | ～ | | -2000 | -2600 |

IMAGE FORMING APPARATUS

CROSS REFERENCE TO RELATED APPLICATION

This application claims priority to Japanese Patent Application No. 2006-235010 filed on Aug. 31, 2006, the disclosure of which is hereby incorporated into the present application by reference.

TECHNICAL FIELD

The present invention relates to an image forming apparatus such as a laser printer.

BACKGROUND

Traditionally, in an image forming apparatus such as a laser printer, there are known a type which a toner image formed on a surface of a photosensitive drum is transferred to a sheet transported by a sheet transport belt, and a type which a toner image formed on a surface of a photosensitive drum is transferred once to an intermediate transfer belt and then transferred to a sheet.

A belt such as the sheet transport belt or the intermediate transfer belt is wound between a driving roller input with a driving force and a driven roller spaced away from the driving roller at a predetermined interval, and contacts the surface of the photosensitive drum. Therefore, a toner and a sheet dust adhere to a surface of the belt when the belt contacts the photosensitive drum and a sheet respectively.

Accordingly, in an image forming apparatus having such a belt, a cleaning roller is provided and opposed to the surface of the belt. The belt is cleaned by generating a potential difference between the cleaning roller and the belt and transferring adherents on the surface of the belt to the cleaning roller by static electricity.

In order to preferably transfer the adherents on the surface of the belt to the cleaning roller, an electric current having a proper value is required to run through the cleaning roller. However, when the electric current applied to the cleaning roller is controlled (electric current control) such that a constant electric current runs through the cleaning roller, the potential difference between the belt and the cleaning roller becomes excessively large in case where a resistance value of the cleaning roller increases due to an influence of a use environment or deterioration over time. As a result, the belt may be broken (by surge).

Therefore, an electric voltage applied to the cleaning roller is generally controlled (voltage control) such that a constant potential difference is generated between the belt and the cleaning roller. However, with this voltage control, when the resistance value of the cleaning roller increases due to the influence of a use environment or deterioration over time, an electric current running through the cleaning roller becomes excessively small, so that it is impossible to preferably transport the adherents on the surface of the belt to the cleaning roller.

SUMMARY

One aspect of the present invention may provide an image forming apparatus which shows an advantageous cleaning performances even when a resistance value of a cleaning roller increases.

The same or different aspect of the present invention may provide an image forming apparatus including a belt, a cleaning roller opposed to a surface of the belt, a voltage generating circuit generating a voltage applied to the cleaning roller, a voltage value detecting circuit detecting a voltage value applied to the cleaning roller, a control unit controlling the voltage generating circuit by inputting a control signal to the voltage generating circuit such that the voltage value detected by the voltage value detecting circuit is set to the same value as a target voltage value, and a target voltage value setting section setting the target voltage value based on a duty of the control signal input from the control unit to the voltage generating circuit.

BRIEF DESCRIPTION OF THE DRAWINGS

FIG. 5 is a diagram showing an example of an absolute humidity calculating table.

FIG. 6 is a diagram showing an example of a target voltage setting table.

DETAILED DESCRIPTION

Embodiments of the present invention will be described hereinafter referring to the accompanying drawings.

First Embodiment

1. Overall Structure of Color Laser Printer

Figure 1:
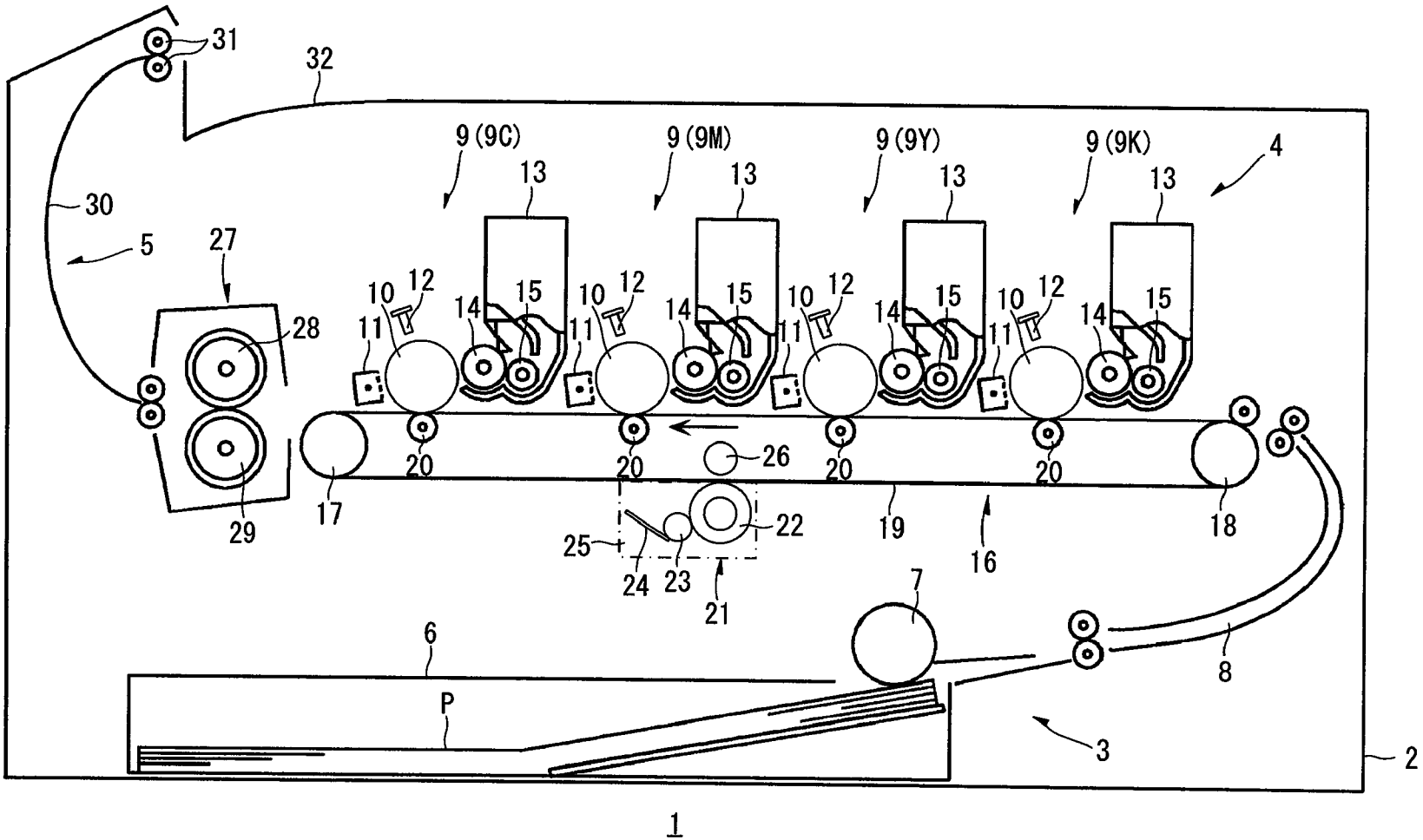
FIG. 1 is a schematic side sectional view of an embodiment of a color laser printer as an example of an image forming apparatus of the present invention.

FIG. 1 is a schematic side sectional view of an embodiment of a color laser printer as an example of an image forming apparatus of the present invention.

This color laser printer 1 is a tandem-type color laser printer in which four process units 9 described later are parallelly arranged in a horizontal direction. In a main body casing 2 in a box shape, a sheet feeding section 3 for feeding a sheet P as an example of a medium, an image forming section 4 for forming an image on the fed sheet P, and a sheet ejecting section 5 for ejecting the sheet P formed with the image thereon are arranged.

(1) Sheet Feeding Section

The sheet feeding section 3 includes a sheet feeding tray 6 for accommodating sheets P in a stacked manner, and a sheet feeding roller 7 for sending the sheets P in the sheet feeding tray 6 one by one. The sheet P sent from the sheet feeding tray 6 passes a sheet transport path 8 and is transported toward the image forming section 4.

(2) Image Forming Section

The image forming section 4 includes the four process units 9. The four process units 9 are provided corresponding to four color of black, yellow, magenta and cyan, and are arranged in the horizontal direction along a transport belt 19 described later. That is, the process units 9 include four process units: a black process unit 9K; a yellow process unit 9Y; a magenta process unit 9M; and a cyan process unit 9C. These four process units 9 are arranged at intervals from the front to the rear in the order of the black process unit 9K, the yellow process unit 9Y, the magenta process unit 9M and the cyan process unit 9C.

Each process unit 9 includes a photosensitive drum 10 as an example of an image carrier, a charger 11 and a developing unit 13.

The photosensitive drum 10 has a cylindrical shape. The photosensitive drum 10 has a positively chargeable photosensitive layer formed of polycarbonate or the like as the outermost surface layer thereof. The photosensitive drum 10 is rotationally driven in the same direction (clockwise in the figure) as the moving direction of the transport belt 19 described later at the time of image formation at a position where the photosensitive drum 10 contacts the transport belt 19.

The charger 11 is a positive chargeable scorotron charger, for example. The charger 11 includes a wire and a grid, and generates a corona discharge by application of a charging bias.

The developing unit 13 stores a toner of each color. The developing unit 13 includes a developing roller 14 for feeding the toner to the surface of the photosensitive drum 10, and a feed roller 15 for feeding the toner to the developing roller 14.

At the time of image formation (development), the photosensitive drum 10 is rotationally driven. Along with this rotation, the surface of the photosensitive drum 10 is uniformly positively charged by the corona discharge from the charger 11. Then, the portion positively charged is exposed to light by a high-speed scanning through a laser beam from an exposing unit 12. Consequently, the surface of the photosensitive drum 10 is formed with an electrostatic latent image of each color corresponding to an image to be formed on the sheet P. This electrostatic latent image is developed into a toner image due to feed of the toner from the developing roller 14.

The exposing unit 12 may comprise an LEQ alley and be provided in each process unit 9. Alternatively, the exposing unit 12 may be arranged above the image forming section 4 as a scanner unit including a light source and a polygonal mirror.

The image forming section 4 further includes a transferring section 16 for transferring the toner image carried on the surface of each photosensitive drum 10 to the sheet P.

The transferring section 16 is arranged below the four process units 9. The transferring section 16 includes a driving roller 17, a driven roller 18 arranged on an upstream side of a transport direction of the sheet P with respect to the driving roller 17 and opposed to the driving roller 17, the transport belt 19 as an example of an endless belt which is wound between the driving roller 17 and the driven roller 18 and whose surface on the upper portion contacts the photosensitive drums 10, transfer rollers 20 opposed to the respective photosensitive drums 10 with the transport belt 19 sandwiched therebetween, and a cleaning unit 21 arranged below the transport belt 19 and opposed to the lower portion of the transport belt 19.

The driving roller 17 is rotated in a reverse direction (counterclockwise in the figure) of the rotation direction of the photosensitive drum 10 by a driving force from a motor (not shown). When the driving roller 17 is rotated, the transport belt 19 moves circumferentially in the same direction (counterclockwise in the figure) as the moving direction of the photosensitive drum 10 at the position where the transport belt 19 contacts the photosensitive drum 10, and the driven roller 18 is driven and rotated.

The sheet P transported from the sheet feeding section 3 to the image forming section 4 is fed onto the transport belt 19, and passes between the photosensitive drums 10 and the transport belt 19 sequentially. During this transportation, the toner images carried on the respective photosensitive drums 10 are transferred onto the sheet P in a superposed manner by a transferring bias applied to the transfer rollers 20.

The cleaning unit 21 includes a primary cleaning roller 22 as an example of a cleaning roller, a secondary cleaning roller 23, a urethane blade 24 and a storage section 25.

The primary cleaning roller 22 extends in a horizontal direction orthogonal to the moving direction of the transport belt 19. The circumferential surface of the primary cleaning roller 22 contacts the surface (lower surface) of the lower portion of the transport belt 19. The primary cleaning roller 22 is formed by covering a shaft made of a conductive material (a material in which an iron material is plated with Ni or a stainless material, for example) with a foam material made of silicone. The primary cleaning roller 22 is rotationally driven in a reverse direction (counterclockwise in the figure) of the moving direction of the transport belt 19 at a position where the primary cleaning roller 22 contacts the transport belt 19.

The secondary cleaning roller 23 extends laterally with the primary cleaning roller 22 and contacts the circumferential surface of the primary cleaning roller 22. The secondary cleaning roller 23 is formed with a bar-shaped member (shaft) made of a conductive material such as an iron material.

A backup roller 26 is arranged in a position where the backup roller 26 is opposed to the primary cleaning roller 22 with the lower portion of the transport belt 19 sandwiched therebetween, and extends parallelly with the primary cleaning roller 22.

At the time of a cleaning process for removing adherents on the surface of the transport belt 19 such as toners and sheet dusts, a primary cleaning voltage BCLN1 is applied to the primary cleaning roller 22, and a secondary cleaning voltage BCLN2 is applied to the secondary cleaning roller 23. On the other hand, the backup roller 26 is grounded. Thus, potential differences are caused between the backup roller 26 (the transport belt 19) and the primary cleaning roller 22 and between the primary cleaning roller 22 and the secondary cleaning roller 23 respectively. The adherents on the surface of the transport belt 19 are transferred onto the primary cleaning roller 22 due to the potential difference between the backup roller 26 and the primary cleaning roller 22. The adherents transferred onto the primary cleaning roller 22 is then transferred onto the secondary cleaning roller 23 due to the potential difference between the primary cleaning roller 22 and the secondary cleaning roller 23. The adherents transferred onto the secondary cleaning roller 23 are scraped by the urethane blade 24 and drop off from the secondary cleaning roller 23 to be stored in the storage section 25.

The image forming section 4 further includes a fixing section 27 for fixing the toner images transferred onto the sheet P.

The fixing section 27 includes a heating roller 28 and a pressure roller 29. The pressure roller 29 is press-contacted against the heating roller 28 from below. The sheet P transported by the transport belt 19 is sent to between the heating roller 28 and the pressure roller 29. While the sheet P passes between the heating roller 28 and the pressure roller 29, the toner images transferred on the sheet P are fixed to the sheet P by heating and pressuring.

(3) Sheet Ejecting Section

The sheet ejecting section 5 includes a sheet transport path 30 which has a C shape in section and opens to the side of the image forming section 4. The sheet P transported from the fixing section 27 passes through the sheet transport path 30, and is ejected by sheet ejecting rollers 31 onto a sheet ejection tray 32 formed on the upper surface of the main body casing 2.

2. Construction of Press-Contact of Backup Roller

Figure 2:
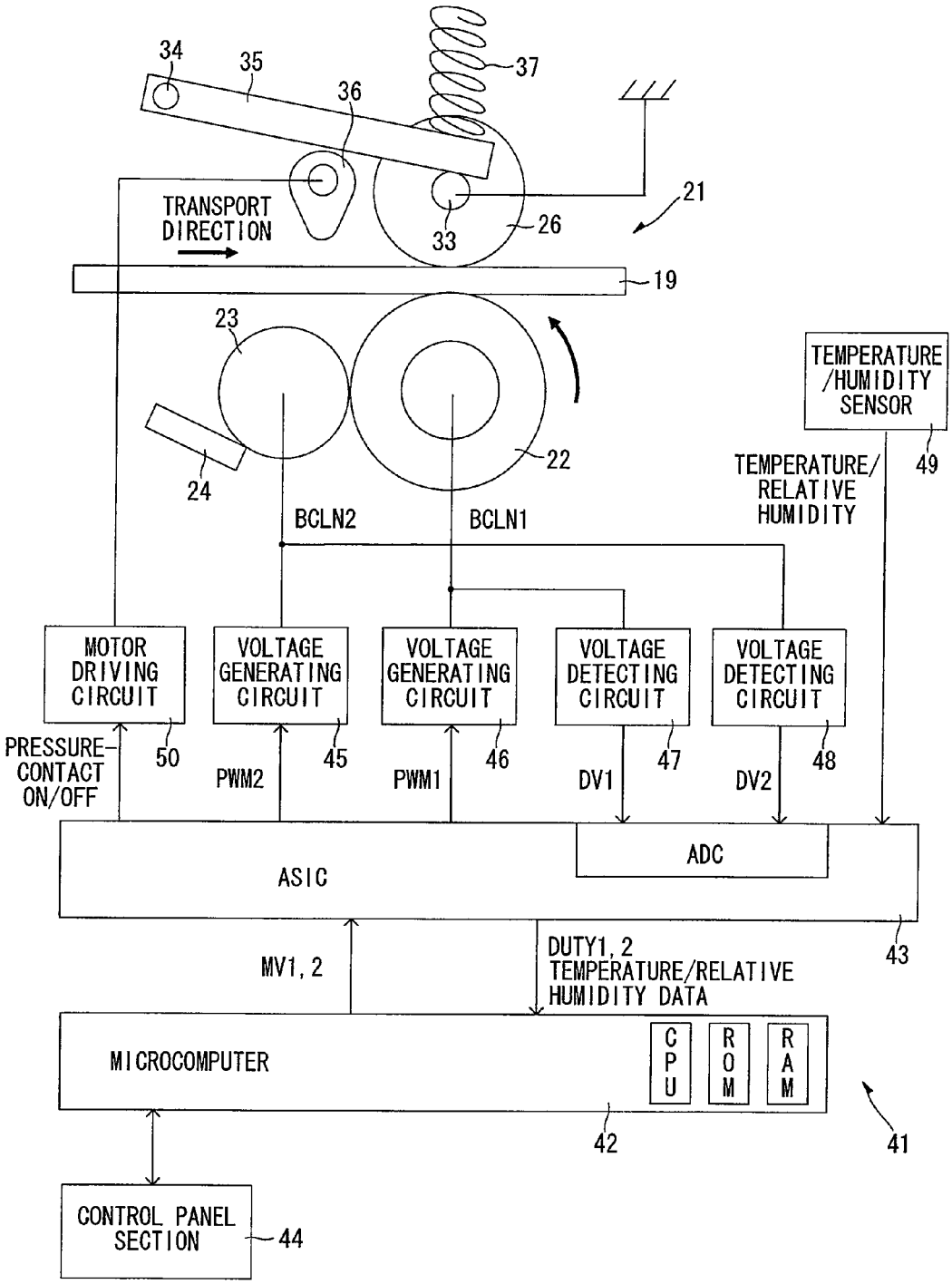
FIG. 2 is an illustrative diagram showing the configuration of a control section for performing a cleaning process, along with the configuration of press-contact of a backup roller (in a heavily press-contacted state).
Figure 3:
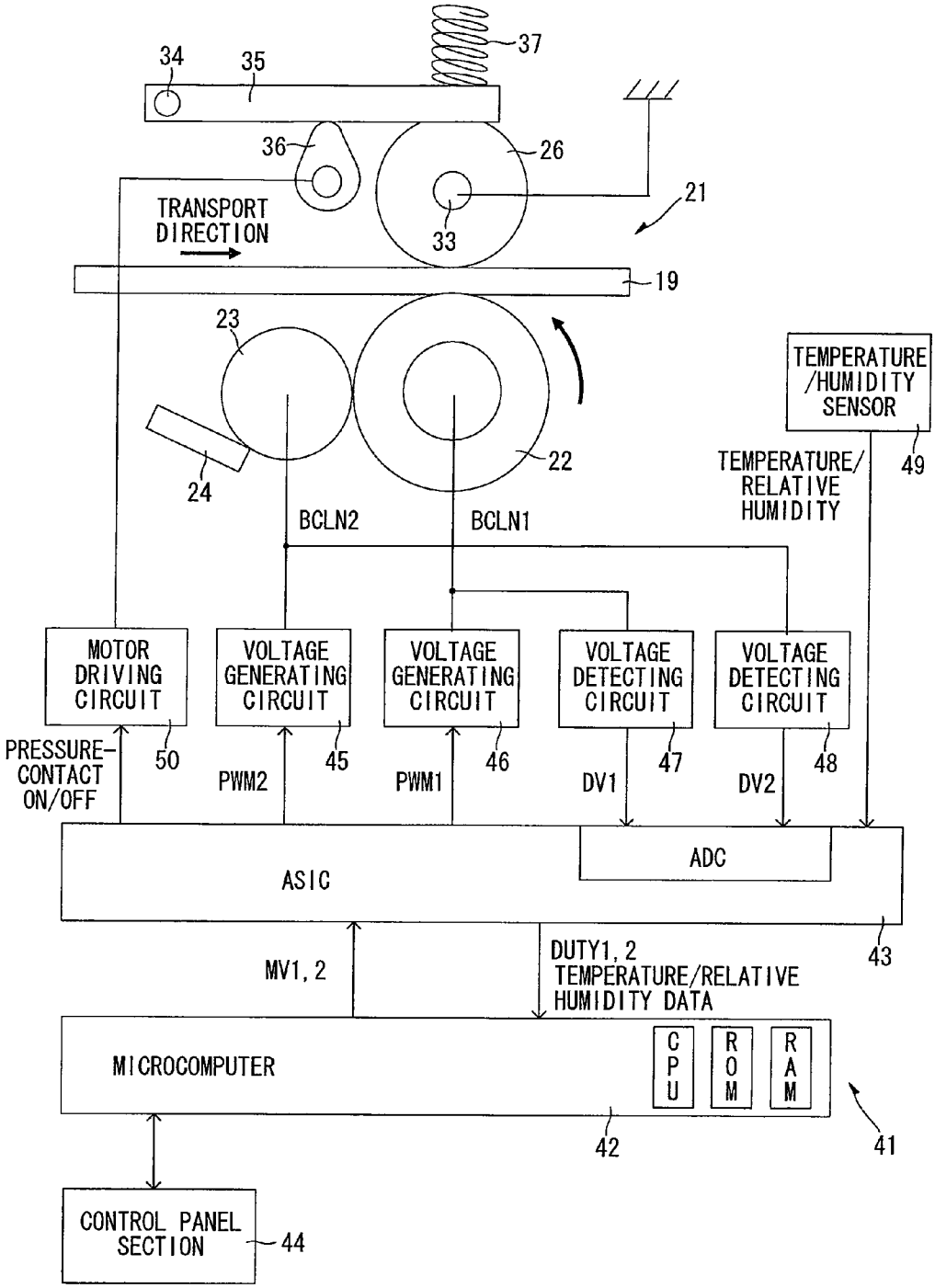
FIG. 3 is an illustrative diagram showing the configuration of the control section for performing a cleaning process, along with the configuration of press-contact of the backup roller (in a lightly press-contacted state).

FIGS. 2 and 3 are each an illustrative diagram showing the configuration of a control section for performing a cleaning process, along with the configuration of press-contact of a backup roller.

The backup roller 26 can be shifted between a state (heavily press-contacted state) of being relatively strongly press-contacted against the primary cleaning roller 22 and a state (lightly press-contacted state) of being relatively weakly press-contacted against the primary cleaning roller 22. Specifically, the color laser printer 1 includes a support shaft 34 extending parallelly with a shaft 33 of the backup roller 26, and an arm 35 pivotably supported at one end thereof by the support shaft 34 and abutting the shaft 33 from above at the other end, a cam 36 contacting the arm 35 from below, and a spring 37 connected to the other end of the arm 35 and urging the arm 35 against the primary cleaning roller 22.

The cam 36 is rotationally driven by a motor (not shown).

In a state where the cam 36 is rotationally driven and thereby the lower peripheral surface thereof (peripheral surface relatively closer to the rotational axis of the cam 36) contacts the arm 35, the arm 35 presses the shaft 33 of the backup roller 26 to the side of the primary cleaning roller 22 by the urging force of the spring 37, as shown in FIG. 2. Thus, the backup roller 26 is put in the heavily press-contacted state where the backup roller 26 is strongly press-contacted against the primary cleaning roller 22.

In a state where the cam 36 is further rotationally driven and thereby the higher peripheral surface thereof (peripheral surface relatively farther from the rotational axis of the cam 36) contacts the arm 35, the arm 35 is lifted up by the cam 36, and the arm 35 is spaced away from the shaft 33 of the backup roller 26. Thus, the backup roller 26 is put in the lightly press-contacted state where the backup roller 26 is press-contacted against the primary cleaning roller 22 due to its own weight.

3. Construction of Control Section

The color laser printer 1 further includes a control section 41 for performing the cleaning process.

The control section 41 includes a microcomputer 42 as an example of a target voltage value setting section and also as an example of an absolute humidity calculating section, and an ASIC 43 as an example of a control unit which inputs and outputs various signals for drive-controlling each section.

The microcomputer 42 includes a CPU, a RAM and a ROM. A control panel section 44 is connected to the microcomputer 42. The control panel section 44 includes input keys for inputting various instructions, and a display panel for showing various information. The control panel section 44 is arranged on the top surface of the main body casing 2 (see FIG. 1), for example.

The ASIC 43 includes a voltage generating circuit 46 generating the primary cleaning a voltage BCLN1 applied to the primary cleaning roller 22, a voltage generating circuit 45 generating the secondary cleaning voltage BCLN2 applied to the secondary cleaning roller 23, a voltage detecting circuit 47 detecting the primary cleaning voltage BCLN1 applied to the primary cleaning roller 22, a voltage detecting circuit 48 detecting the secondary cleaning voltage BCLN2 applied to the secondary cleaning roller 23, and a motor driving circuit 50 driving a motor (not shown) rotating the cam 36.

The color laser printer 1 further includes a temperature/humidity sensor 49 for detecting a temperature and a relative humidity around the cleaning unit 21. A detection signal of the temperature/humidity sensor 49 is input to the ASIC 43.

The ASIC 43 sets a duty DUTY1 of a PWM (Pulse Width Modulation) control signal PWML input to the voltage generating circuit 46 such that a detected voltage value DV1 detected by the voltage detecting circuit 47 is the same as a target voltage value NV1 of the primary cleaning voltage BCLN1 set by the microcomputer 42. The voltage generating circuit 46 supplies the primary cleaning roller 22 with an electric power corresponding to the duty DUTY1 of the PWM control signal PWM1. The primary cleaning voltage BCLN1 is determined by a magnitude of the electric power output from the voltage generating circuit 46 and a resistance value of the primary cleaning roller 22 receiving the electric power.

Further, the ASIC 43 sets a duty DUTY2 of a PWM control signal PWM2 input to the voltage generating circuit 45 such that a detected voltage value DV2 detected by the voltage detecting circuit 48 is the same as a target voltage value NV2 of the secondary cleaning voltage BCLN2 set by the microcomputer 42. The voltage generating circuit 45 supplies the secondary cleaning roller 23 with an electric power corresponding to the duty DUTY2 of the PWM control signal PWM2. The secondary cleaning voltage BCLN2 is determined by a magnitude of the electric power output from the voltage generating circuit 45 and a resistance value of the secondary cleaning roller 23 receiving the electric power.

Further, the ASIC 43 has a function to inform the microcomputer 42 of the duty DUTY1 of the PWM control signal PWM1 and the duty DUTY2 of the PWM control signal PWM2. The ASIC 43 also has a function to input the microcomputer 42 with data of the temperature and the relative humidity obtained from the detection signal which is input from the temperature/humidity sensor 49.

In the cleaning process described next, the microcomputer 42 sets the target voltage value NV1 of the primary cleaning voltage BCLN1 and the target voltage value NV2 of the secondary cleaning voltage BCLN2 based on the duty DUTY1 and the data of the temperature and the relative humidity.

4. Cleaning Process

Figure 4:
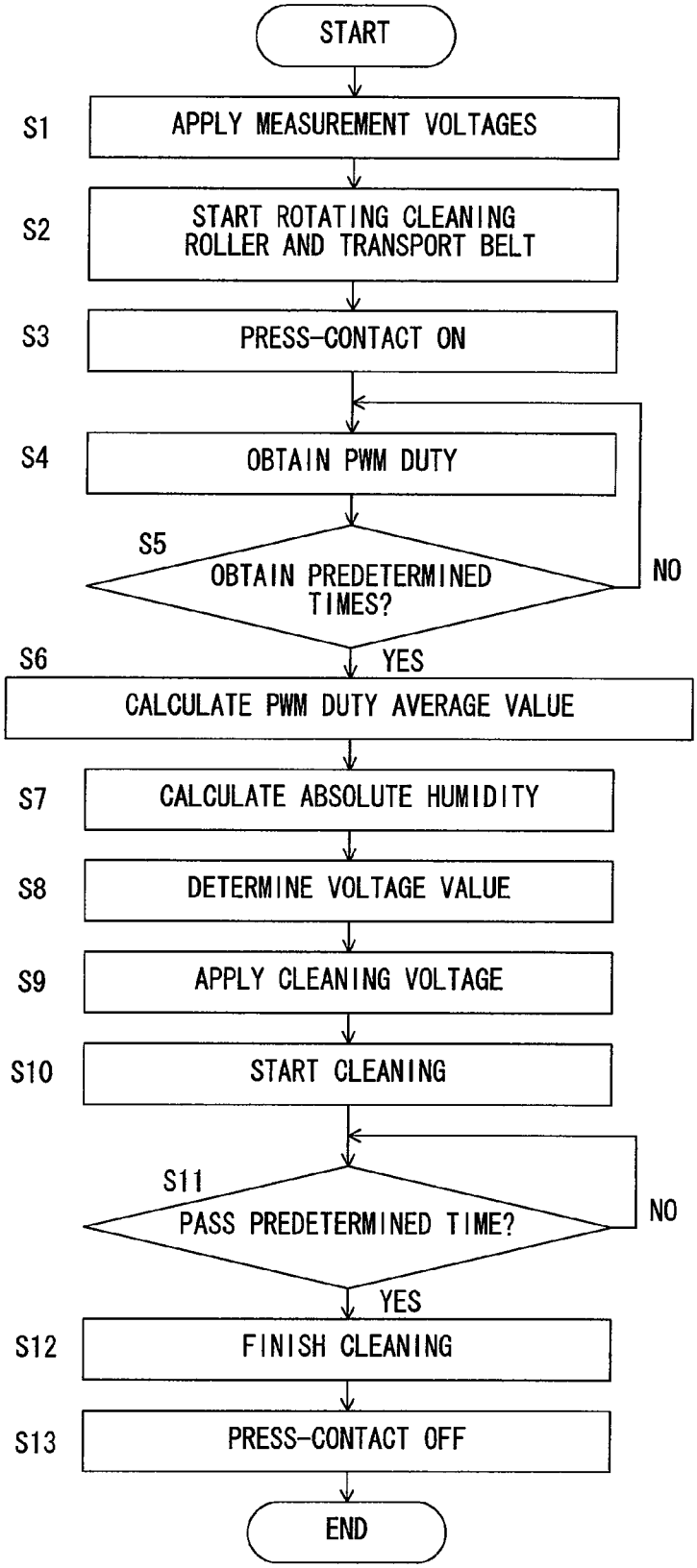
FIG. 4 is a flowchart for explaining the cleaning process.

FIG. 4 is a flow chart for explaining the cleaning process.

This cleaning process is started in response to turning on the color laser printer 1 or inputting an instruction for forming an image (printing instruction), for example.

First, the primary cleaning roller 22 and the secondary cleaning roller 23 are respectively applied with 800 V and 1200 V as voltages measurement (S1).

Next, the rotation of the primary cleaning roller 22 is started, and the circumferential movement of the transport belt 19 is also started (S2).

Further, the cam 36 is rotationally driven, and the lower peripheral surface thereof is put in a state of being contacted with the arm 35. Thus, the backup roller 26 is put in the heavily press-contacted state of being strongly pressed against the primary cleaning roller 22 (S3: Press-contact ON).

After 1.5 seconds have passed from the start of rotation of the primary cleaning roller 22, the microcomputer 42 periodically obtains the duty DUTY1 informed form the ASIC 43 predetermined times (S4). For example, the microcomputer 42 obtains the duty DUTY1 128 times in 5 msec cycle.

When the microcomputer 42 finishes obtaining the duty DUTY1 predetermined times (S5: YES), the microcomputer 42 calculates an average value of the obtained duties DUTY1 (S6).

Further, the microcomputer 42 calculates an absolute humidity around the cleaning unit 21 based on the data of the temperature and the relative humidity input from the ASIC 43 (S7). Specifically, the microcomputer 42 refers to an absolute humidity calculating table shown in FIG. 5 to calculate the absolute humidity Ha around the cleaning unit 21.

The absolute humidity calculating table shown in FIG. 5 is stored in the ROM of the microcomputer 42. The absolute humidity calculating table is produced by calculating the absolute humidity Ha ($g/m^3$) using a calculating formula based on the temperature T (° C.) and the relative humidity ψ (%) as parameters, obtaining an average value of the relative humidities ψ per appropriate range of the temperature and that of the humidity, and storing them in the ROM while associating them with each other.

In this embodiment, the absolute humidity calculating table is divided into seven segments based on ranges of the temperature T (not less than 32° C., not less than 28° C. and not more than 31° C., not less than 24° C. and not more than 27° C., not less than 20° C. and not more than 23° C., not less than 16° C. and not more than 19° C., not less than 12° C. and not more than 15° C., and not more than 11° C.). Each segment is further divided into five segments based on ranges of the relative humidity ψ (not less than 80%, not less than 60% and not more than 79%, not less than 40% and not more than 59%, not less than 20% and not more than 39%, and not more than 19%). Each absolute humidity Ha corresponds to one of these five segments. For example, the absolute humidity Ha=16 ($g/m^3$) is stored corresponding to the segment where the temperature T is not less than 28° C. and not more than 31° C. and the relative humidity ψ is not less than 40% and not more than 59%.

Referring to FIG. 4 again, when the microcomputer 42 calculates the average value of the duties DUTY1 and the absolute humidity Ha around the cleaning unit 21, the microcomputer 42 sets the target voltage value NV1 of the primary cleaning voltage BCLN1 and the target voltage value NV2 of the secondary cleaning voltage BCLN2 based on these calculation results (S8). Specifically, the microcomputer 42 sets the target voltage values NV1 and NV2 by referring to a target voltage value setting table as an example of a table shown in FIG. 6.

The target voltage value setting table shown in FIG. 6 is stored in the ROM of the microcomputer 42. The absolute humidity Ha and the duty DUTY1 are changed, to determine the primary cleaning voltage BCLN1 and the secondary cleaning voltage BCLN2 by which adherents on the transport belt 19 can be advantageously collected into the storage section 25 in each condition. Respective average values of the primary cleaning voltage BCLN1 and the secondary cleaning voltage BCLN2 are calculated per appropriate range of the absolute humidity Ha and that of the duty DUTY1, and they associates and stores in the ROM. Thus, the target voltage value setting table is produced.

In this embodiment, the target voltage value setting table is divided into three segments based on ranges of the absolute humidity Ha (not less than 10 $g/m^3$ and not more than 30 $g/m^3$, not less than 5 $g/m^3$ and not more than 9 $g/m^3$, not less than 1 $g/m^3$ and not more than 4 $g/m^3$). The range: not less than 10 $g/m^3$ and not more than 30 $g/m^3$ is further divided into three segments based on ranges of the average value of the duty DUTY1 (not more than 55.5%, not less than 55.6% and not more than 60.5%, and not less than 60.6%). The target voltage value NV1 of the primary cleaning voltage BCLN1 and the target voltage value NV2 of the secondary cleaning voltage BCLN2 correspond to one of these three segments. The range: not less than 5 $g/m^3$ and not more than 9 $g/m^3$ is further divided into four segments based on ranges of the average value of the duty DUTY1 (not more than 57.0%, not less than 57.1% and not more than 62.5%, not less than 62.6% and not more than 64.0%, and not less than 64.1%). The target voltage value NV1 of the primary cleaning voltage BCLN1 and the target voltage value NV2 of the secondary cleaning voltage BCLN2 correspond to one of these four segments. Moreover, the range: not less than 1 $g/m^3$ and not more than 4 $g/m^3$ is further divided into four segments based on ranges of the average value of the duty DUTY1 (not more than 65.0%, not less than 65.1% and not more than 67.0%, not less than 67.1% and not more than 67.5%, and not less than 67.6%). The target voltage value NV1 of the primary cleaning voltage BCLN1 and the target voltage value NV2 of the secondary cleaning voltage BCLN2 correspond to one of these four segments. For example, the target voltage value NV1 of the primary cleaning voltage BCLN1=−1300 V and the target voltage value NV2 of the secondary cleaning voltage BCLN2=−1700 V are stored corresponding to the segment where the absolute humidity Ha is not less than 5 $g/m^3$ and not more than 9 $g/m^3$ and the average value of the duty DUTY1 is not less than 57.1% and not more than 62.5%.

Referring to FIG. 4 again, when the target voltage values NV1 and NV2 are thus set, the primary cleaning voltage BCLN1 of the target voltage value NV1 and the secondary cleaning voltage BCLN2 of the target voltage value NV2 which have been set are applied to the primary cleaning roller 22 and the secondary cleaning roller 23 respectively (S9). Thus, cleaning is started for positively removing the adherents from the transport belt 19 (S10).

After a predetermined time has passed from the start of the cleaning (S12: YES), the applications of the primary cleaning voltage BCLN1 on the primary cleaning roller 22 and the secondary cleaning voltage BCLN2 on the secondary cleaning roller 23 are stopped. Further, the rotation of the primary cleaning roller 22 is stopped, and the circumferential movement of the transport belt 19 is also stopped. Thus, the cleaning for positively removing the adherents from the transport belt 19 is finished (S12).

Thereafter, the cam 36 is rotationally driven and put in a state where the higher peripheral surface thereof is in contact with the arm 35. Thus, the backup roller 26 is put in the lightly press-contacted state where the backup roller 26 weakly press-contacts the primary cleaning roller 22 by its own weight (S13: Press-contact OFF). This lightly press-contacted state is maintained until when the next cleaning process is started and the lower peripheral surface of the cam 36 is put in the state of being contacted with the arm 35. The image forming operation (printing operation) to the sheet P is performed in this lightly press-contacted state.

5. Effects

As described above, in the color laser printer 1, the target voltage value NV1 to be applied to the primary cleaning roller 22 is set based on the duty DUTY1 of the PWM control signal PWML input to the voltage generating circuit 46 from the ASIC 43.

Specifically, in the feedback control where the voltage value applied to the primary cleaning roller 22 is set to the same value as the target voltage value NV1, the duty DUTY1 is changed such that the voltage value applied to the primary cleaning roller 22 is the same as the target voltage value NV1. An electric current value required for applying the same voltage value on the primary cleaning roller 22 is different between a high state and a low state of the resistance value of the primary cleaning roller 22, so that the duty DUTY1 is set corresponding to the electric current value. That is, the duty DUTY1 corresponds to the resistance value of the primary cleaning roller 22.

Accordingly, by setting the target voltage value NV1 based on the duty DUTY1, the primary cleaning voltage BCLN1 corresponding to the resistance value of the primary cleaning roller 22 can be applied to the primary cleaning roller 22. Therefore, even when the resistance value of the primary cleaning roller 22 increases, an enough potential difference can be generated between the transport belt 19 and the primary cleaning roller 22 in order to transfer the adherents on the surface of the transport belt 19 to the primary cleaning roller 22. As a result, even when the resistance value of the primary cleaning roller 22 increases, an advantageous cleaning performance can be obtained.

Further, in the color laser printer 1, the temperature T and the relative humidity ψ around the primary cleaning roller 22 are detected, and the absolute humidity Ha is calculated based on the detected temperature T and relative humidity ψ. Then, the target voltage value NV1 to be applied to the primary cleaning roller 22 is set based on the absolute humidity Ha and the duty DUTY1.

The performance of cleaning the transport belt 19 by the primary cleaning roller 22 is varied depending on the absolute humidity (the temperature T and the relative humidity ψ) around the primary cleaning roller 22. Therefore, by setting the target voltage value NV1, in addition to the duty DUTY1, based on the absolute humidity Ha, the adherents on the surface of the transport belt 19 can be advantageously transferred to the primary cleaning roller 22 irrespective of a value of the absolute humidity Ha. As a result, a further advantageous cleaning performance can be obtained.

Further, the color laser printer 1 includes the target voltage value setting table storing the target voltage value NV1 corresponding to the duty DUTY1 and the absolute humidity Ha. Accordingly, the target voltage value NV1 corresponding to the duty DUTY1 and the absolute humidity Ha can be speedily set by referring to the target voltage value setting table. Further, it is not needed to calculate the target voltage value NV1 corresponding to the duty DUTY1 and the absolute humidity Ha, so that a load on the microcomputer 42 can be decreased.

Second Embodiment

Also at the time of image forming operation (in the lightly press-contacted state), the target voltage value NV1 corresponding to the duty DUTY1 and the absolute humidity Ha may be set, as is the case in the above-mentioned cleaning process.

Third Embodiment

The above description shows the case where the present invention is applied to the cleaning of the transport belt 19 transporting the sheet P in the color laser printer 1 of the tandem type. However, the present invention can also be applied to cleaning of an intermediate transfer belt in an intermediate-transfer-type color laser printer where toner images for respective colors are transferred from respective image carriers to the intermediate transfer belt and then collectively transferred from the intermediate transfer belt to a sheet. The present invention canal so be applied to cleaning of a transport belt for transporting a sheet and an intermediate transfer belt in a monochrome laser printer.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus, comprising:

a belt;

a cleaning roller opposed to a surface of the belt;

a voltage generating circuit generating a voltage applied to the cleaning roller;

a voltage value detecting circuit detecting a voltage value applied to the cleaning roller;

a control unit controlling the voltage generating circuit by inputting a control signal to the voltage generating circuit such that the voltage value detected by the voltage value detecting circuit is set to the same value as a target voltage value; and a target voltage value setting section setting the target voltage value based on a duty of the control signal input from the control unit to the voltage generating circuit.

2. An image forming apparatus according to claim 1, comprising:

a temperature/humidity sensor detecting a temperature and a relative humidity around the cleaning roller; and an absolute humidity calculating section calculating an absolute humidity based on the temperature and the relative humidity detected by the temperature/humidity sensor, wherein the target voltage value setting section sets the target voltage value based on the duty and the absolute humidity calculated by the absolute humidity calculating section.

3. An image forming apparatus according to claim 2, comprising:

a table storing the target voltage value corresponding to the duty and the absolute humidity, wherein the target voltage value setting section sets the target voltage value by referring to the table.

4. An image forming apparatus according to claim 1, comprising a plurality of image carriers arranged along the belt and carrying respective developing agent images.

5. An image forming apparatus according to claim 4, wherein the belt is a transport belt transporting a medium to be transferred with the developing agent image to a position where the medium is opposed to the image carrier.

* * * * *